United States Patent [19]

Scheufler et al.

[11] 4,202,252

[45] May 13, 1980

[54] THROUGHPUT-ADJUSTABLE FLUID-DISPLACEMENT MACHINE

[75] Inventors: Bernd Scheufler; Heinz Müller, both of Brunswick, Fed. Rep. of Germany

[73] Assignee: Feinmechanische Werke Mainz GmbH, Mainz, Fed. Rep. of Germany

[21] Appl. No.: 895,661

[22] Filed: Apr. 12, 1978

[30] Foreign Application Priority Data

Apr. 14, 1977 [DE] Fed. Rep. of Germany ..... 2716496

[51] Int. Cl.[2] ..... F01B 13/06

[52] U.S. Cl. ..... 91/483; 91/492

[58] Field of Search ..... 91/492, 482, 483, 501

[56] References Cited

U.S. PATENT DOCUMENTS

| | | | |
|---|---|---|---|
| 2,847,938 | 8/1958 | Goudek | 91/483 |
| 3,036,528 | 5/1962 | Klopp | 91/492 |
| 3,661,057 | 5/1972 | Rogov | 91/482 |
| 3,776,102 | 12/1973 | Kafayama | 91/501 |
| 4,086,895 | 5/1978 | Takagi | 91/501 |

FOREIGN PATENT DOCUMENTS

| | | | |
|---|---|---|---|
| 327016 | 3/1930 | United Kingdom | 91/501 |

*Primary Examiner*—William L. Freeh

*Attorney, Agent, or Firm*—Michael J. Striker

[57] ABSTRACT

A throughput-adjustable fluid-displacement machine includes a stator and a rotor which is supported on the stator for rotation about an axis. The stator has two axially spaced circumferentially extending cam tracks and the rotor has two sets of passages therein, each of the passages having an open end which always faces a different one of the cam tracks for each of the sets of passages. A plurality of pistons is respectively accommodated in the above-mentioned passages, each of the pistons having a cam follower portion and being acted on by a spring which urges the cam follower portion into a constant contact with the respective cam track so that the piston reciprocates in dependence on the configuration of the respective cam track. Two control sleeves, one for each of the sets of passages, is interposed between and selectively communicates the working chambers of the respective passages with respective input and output conduits of the machine. An angularly displacing arrangement is provided which displaces the two control sleeves simultaneously but in opposite directions whereby the throughput of the machine is adjusted while maintaining a substantially pulsation-free flow through the conduits. Preferably, the two control sleeves are displaced at the same angles in the opposite directions.

9 Claims, 8 Drawing Figures

(C - D)

(A-B)

THROUGHPUT-ADJUSTABLE FLUID-DISPLACEMENT MACHINE

BACKGROUND OF THE INVENTION

The present invention relates to a fluid-displacement machine, such as a pump or motor, in general, and more particularly to a radial piston machine.

Fluid-displacement machines of the above-mentioned type are already known in a variety of constructions. Such fluid-displacement machines include stator and rotor components, a plurality of cylinder-receiving passages in the rotor, a plurality of pistons each accommodated in one of the passages and having a cam follower portion, at least one cam track which extends circumferentially about the above-mentioned axis, and biasing means which urges the pistons toward the cam track so that the cam follower portions of the pistons follow the configuration of the latter. In addition thereto, the conventional machines also include at least one control member, such as a control sleeve, which is interposed between the working chambers of the respective passages and the respective low-pressure and high-pressure conduits of the machine and controls the communication of the respective working chambers with the respective conduits.

One conventional machine of this type which is disclosed in the German patent DT-PS 2,209,996 is an axial piston machine the rotor of which accommodates two sets of pistons for reciprocation in the respective passages. This conventional machine includes two cam tracks, each arranged at one axial end of the machine and each being associated with one of the sets of the pistons. One of the above-mentioned cam tracks is mounted on the machine for angular movement about the axis thereof by means of a worm transmission which can be actuated from the exterior of the machine. A pinion is mounted on one end face of the rotatable control sleeve between the outer periphery of the rotor and the inner periphery of the housing of the machine, the pinion meshing with a gear annulus of the housing and also with a gear annulus of the angularly movable cam track so that, when the cam track is angularly moved relative to the housing, the control sleeve is angularly displaced by one half of the angle of movement of the movable cam track. In this machine, always two axially opposite pistons of the two sets of pistons are accommodated in a common passage.

The cam tracks of the above-mentioned conventional axial piston machine are provided on respective disks, and each of the cam tracks has a plurality of, such as nine, raised portions. Thus, during each of the rotations of the rotor, each of the cam follower portions, in cooperation with the associated biasing spring or the like, will reciprocate the associated piston a number of times which corresponds to the number of the raised portions of the respective cam track. The cam tracks of the disks are so arranged that, when the machine is being used as a motor, the sum total of the driving torques is maintained constant. On the other hand, when the machine is being used as a pump, the configurations of the cam tracks are such that the output pressure of the pump remains constant. As a result of the positively simultaneous angular displacement of the cam disk which carries the cam track and the control sleeve, via the interposed pinion, it is possible to steplessly change the amount of the working fluid. Furthermore, it is possible to reverse the direction of flow of the working fluid without any need for providing any additional valves or the like.

However, the above-mentioned machine is also disadvantageous in some respects. First of all, the reaction torque must be applied to the rotatable cam disk. Thus, when the cam disk is to be angularly moved, a portion of the reaction torque must be overcome. Thus, the angular movement or adjustment requires a considerably high expenditure of force. Correspondingly to this, there results the disadvantageous requirement for the provision of a reduction gear train which then requires a correspondingly high expenditure in terms of labor and materials.

In addition thereto, the above-explained axial piston machine renders it possible to achieve a pulsation-free operation, at the very best, only for a single optimized adjustment point. On the other hand, when this optimum point is departed from as a result of the angular adjustment of the cam disk or of the control sleeve, a pulsation-free input or output volume of the working fluid is no longer obtained. Furthermore, the conventional machine of this type does not possess a uniform input or output torque at constant loading throughout the adjustment range thereof.

SUMMARY OF THE INVENTION

Accordingly, it is a general object of the present invention to avoid the above-mentioned disadvantages.

More particularly, it is an object of the present invention to provide a fluid-displacement machine which is not possessed of the disadvantages of the prior-art machines of this type.

Furthermore, it is an object of the present invention to so design the fluid-displacement machine as to be adjustable in throughput, while maintaining a virtually pulsation-free flow of the working fluid therethrough.

A further object of the present invention is to develop a fluid-displacement machine in which only a minimum force is required for adjusting the throughput rate of the machine.

A concomitant object of the present invention is to provide a fluid-displacement machine which is simple in construction, inexpensive to manufacture and reliable nevertheless.

In pursuance of these objects and others which will become apparent hereafter, one feature of the present invention resides, briefly stated, in a fluid-displacement machine which comprises a stator component; a rotor component mounted on said stator component for rotation about an axis relative thereto; two axially spaced circumferentially extending cam tracks both stationary relative to said stator component; means for bounding two sets of radially extending passages in said rotor component, said passages having respective open ends which always face a different one of said cam tracks for each of said sets; a plurality of pistons each accommodated for reciprocation in one of said passages of said two sets and each bounding a chamber in said one passage, each of said pistons also having a cam follower portion; means for so biasing each respective piston toward the respective cam track that said cam follower portion thereof follows the configuration of the respective cam track and thus reciprocates the respective piston in the associated passage in dependence on the above-mentioned configuration; high-pressure and low-pressure conduits; means for communicating said conduits with said chambers, the communicating means including two control members each of which is interposed between said conduits and said chambers of one of said sets and each of which is mounted for angular displacement about said axis relative to said stator component; and means for simultaneously angularly displacing said two control members in opposite directions relative to said stator component and for arresting said control members in the respectively assumed positions thereof.

Thus, the machine of the present invention is preferably a radial piston machine which has stationarily arranged cam tracks, but which is also equipped with two control members, preferably control sleeves, which are angularly displaced with respect to one another. In this context, it is particularly advantageous when, as further proposed by the present invention, the two control members are simultaneously displaced by the common angularly displacing means through the same angle, but in opposite directions.

According to a further aspect of the present invention, it is desired to so select the number of the passages in each of the sets thereof, as well as the number of raised portions per cam track and thus the number of piston reciprocations per rotation of the rotor, with respect to the characteristic of the individual throughput volume of the individual pistons, that a constant volume is obtained as a result of the summation of all individual volumes during the rotation of the rotor.

The individual torque, or the individual volume, of each of the pistons of a hydraulic radial piston machine is dependent on the "related" relative speed of the piston which is determined by the configuration of the respective cam track with which the respective piston cooperates during the rotation of the rotor. For a constant total torque, or for a constant total displacement volume, which respectively result from the summations of the individual torques of all pistons which are acted on by a high-pressure fluid, or of all of the pistons which, at a given time, are in their delivery phase of the cycle of operation thereof, it is necessary to so select a number of the pistons and the associated passages, given a desired configuration of the respective cam tracks, that a predetermined relationship, which is characteristic for the predetermined configuration of the cam track, between the number of the pistons or passages and the common divisor of the number of pistons or passages and the number of reciprocations, be adhered to.

Thus, for a sinusoidal motion law, the present invention is preferably characterized by the equation $m/T=5$, wherein m is the number of pistons or passages per set and T is the common divisor of m and of the number of the raised portions per cam track. A radial piston machine in which the pistons reciprocate two or four times per rotation of the rotor, and having ten pistons or passages in each of the sets satisfies this requirement and, therefore, has a constant throughput rate and a constant total torque.

In the arrangement according to the present invention, only viscous friction is to be overcome when the control members or sleeves are to be angularly displaced. Thus, the adjustment or displacement forces are considerably lower than those to be applied in the above-mentioned prior-art machines, which is particularly advantageous when the machine is used in connection with servo controls of low throughputs.

As already mentioned before, it is particularly advantageous when the two control members are sleeves which axially abut each other. Then, it is also advantageous when the rotor component surrounds and is supported on the sleeves, the rotor component being advantageously further supported in a cantilevered fashion in a housing lid of a housing which constitutes the stator.

In the context of the present invention, it is particularly advantageous when the angularly displacing means for one of the sleeves includes a displacing shaft coaxially accommodated in the rotor component, a connecting disk mounted on the displacing shaft for joint rotation therewith, and means for rigidly connecting said one sleeve to said connecting disk. Then, it is also very advantageous when the angularly displacing means for the other of the sleeve includes a gear which is connected to said other sleeve for joint rotation therewith. It is further very advantageous when the above-mentioned gear is a bevel gear, when the angularly displacing means for the one sleeve further includes another bevel gear mounted on said displacing shaft for joint rotation therewith, and when the angularly displacing means further includes means for driving the bevel gear and the other bevel gear in opposite directions about said axis. It is particularly advantageous in this context when the driving means includes a common bevel gear which meshes with the bevel gear and with the other bevel gear to drive the same at the same angular speeds.

When the machine of the present invention is constructed in the above-mentioned manner, and particularly when the rotor and the cam tracks are respectively symmetrical with respect to the axis of rotation, the resulting force of all forces which act on the rotor component is so oriented that the rotor is subjected to a pure torque about the axis of rotation thereof. In other words, no tilting moment is encountered which would have to be counteracted at the respective bearings of the rotor component. Inasmuch as no reaction forces are encountered at the respective bearings, there is obtained a balanced rotor component. However, a special advantage of the novel radial piston machine is to be seen in the fact that a pulsation-free input or output volume is obtained throughout the entire adjustment range of the machine, as well as a uniform input or output torque at constant loading throughout the adjustment range of the machine.

The novel features which are considered as characteristic for the invention are set forth in particular in the appended claims. The invention itself, however, both as to its constructions and its method of operation, together with additional objects and advantages thereof, will be best understood from the following description of specific embodiments when read in connection with the accompanying drawings.

DESCRIPTION OF THE PREFERRED EMBODIMENTS

Figure 1:
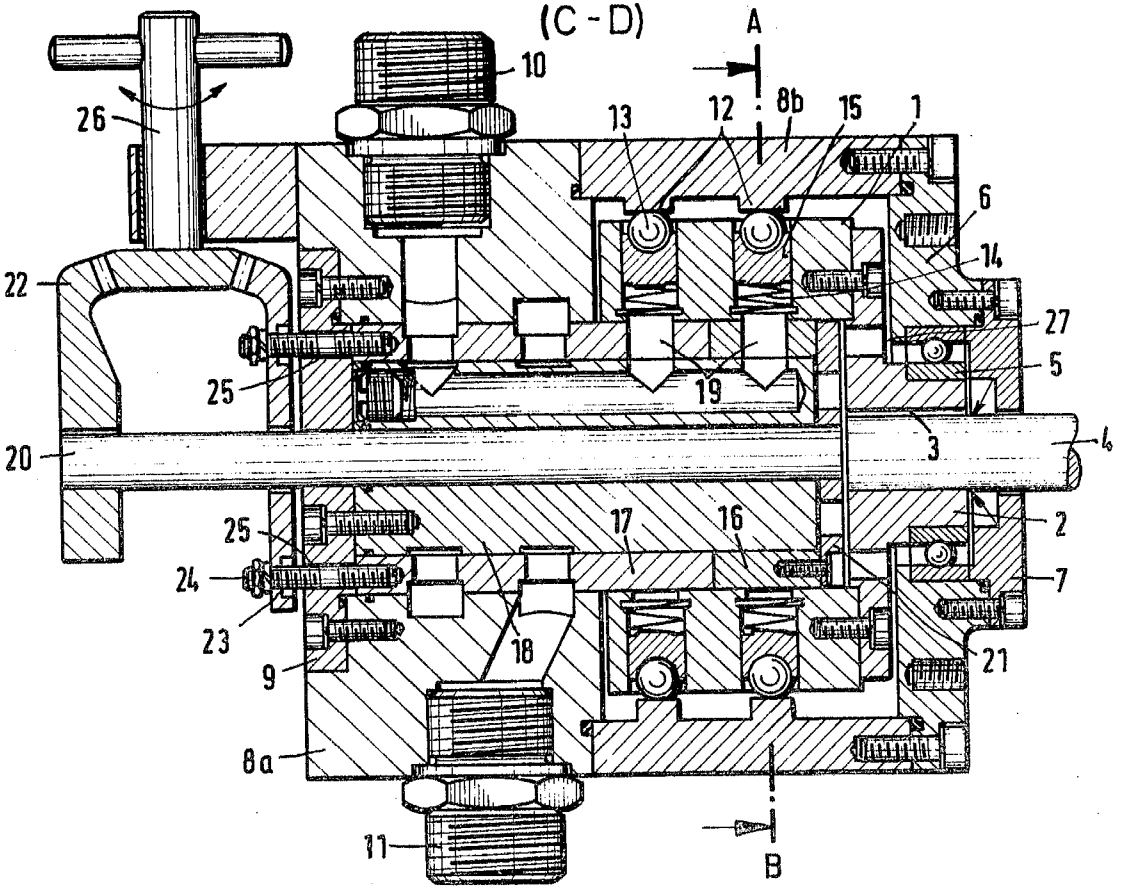
FIG. 1 is a longitudinal section of a radial piston machine of the present invention taken on line I—I of FIG. 2.
Figure 2:
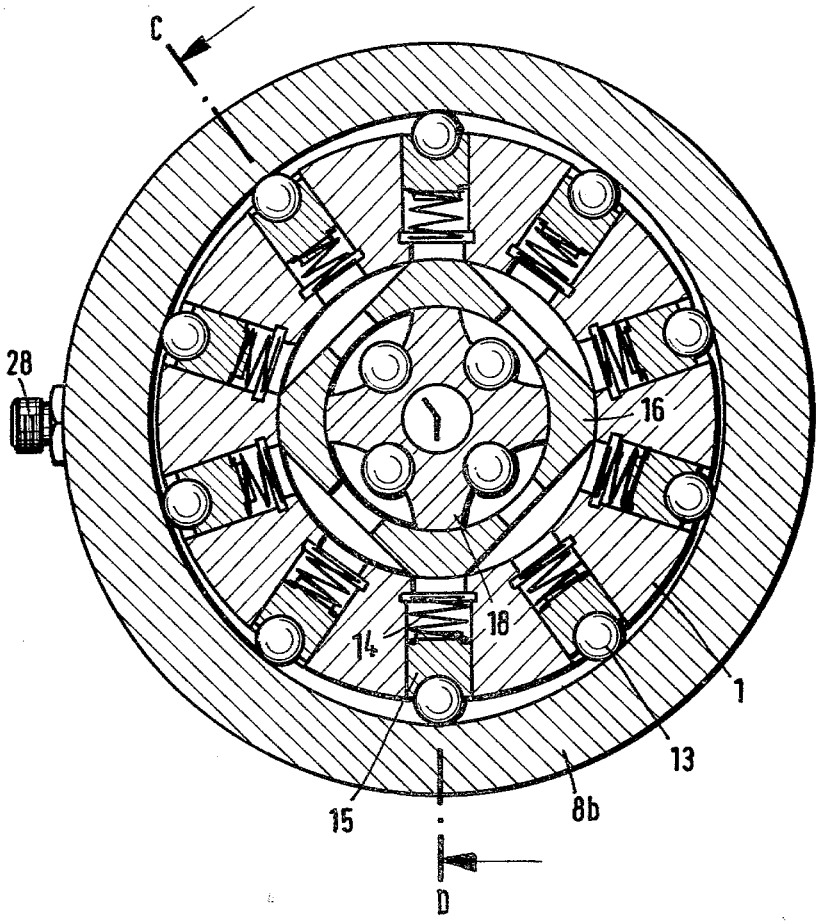
FIG. 2 is a cross-sectional view taken on line II—II of FIG. 1.
Figure 3:
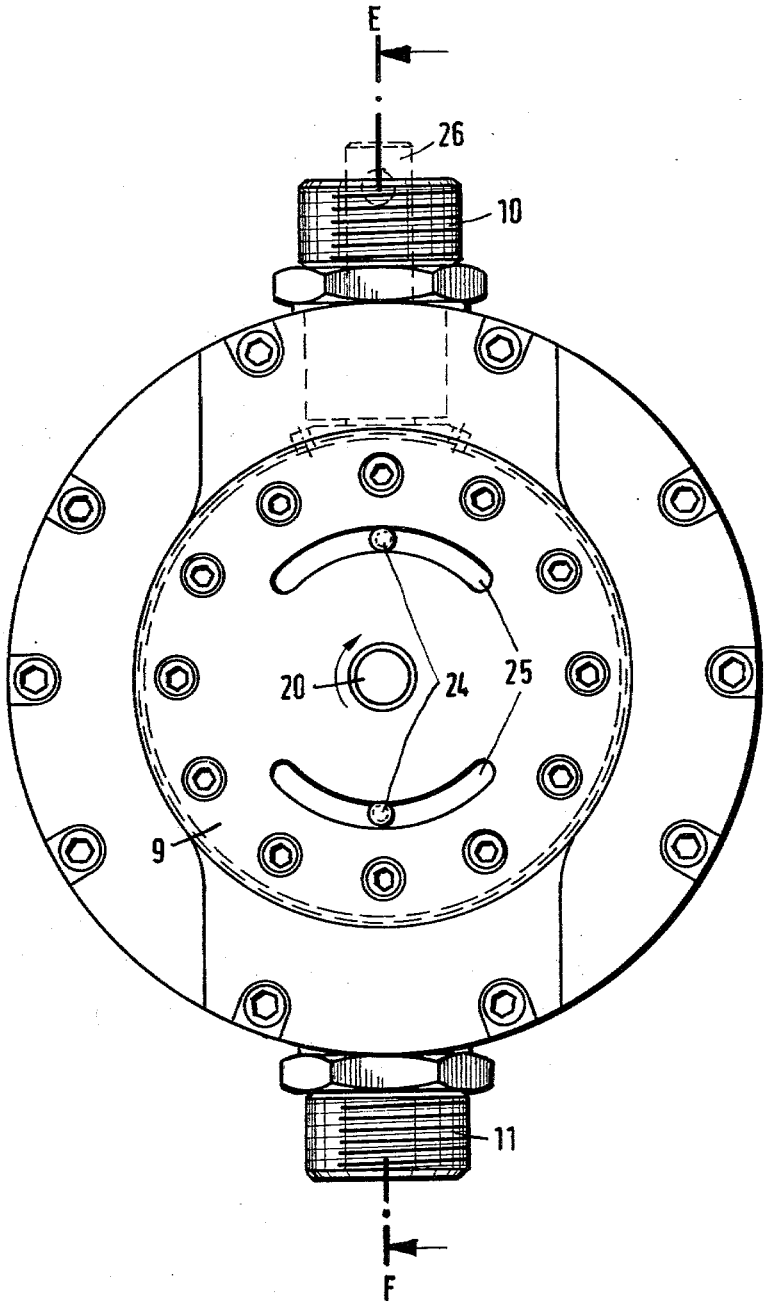
FIG. 3 is an end view of the machine taken on line III—III of FIG. 1.

Referring now to the drawings in detail, and first to FIGS. 1-3 thereof, it may be seen that the reference numeral 1 has been used therein to indicate a rotor component of a radial piston machine. The rotor 1 has a rotor flange 2 attached thereto, for instance, by screws. The rotor flange 2 is connected to a displacement shaft 4 for joint rotation therewith by means of a key 3. The rotor flange 2 is supported, via a bearing 5, in a housing lid 6 which, in turn, is closed by a bearing cover 7. The machine further includes a housing which consists of two parts 8*a* and 8*b*, respectively, the housing 8*a*, 8*b* being closed, at its end which is remote from the housing lid 6, by another housing lid 9. Two pressure-medium nipples 10 and 11 are provided in the part 8*a* of the machine housing 8*a*, 8*b*, which nipples 10 and 11 are to be connected to an input or an output conduit, respectively.

Two axially adjacent cam tracks 12 are stationarily provided at the inner circumferential surface of the part 8*b* of the machine housing 8*a*, 8*b*. One set of pistons 13 abuts with its spherical cam-follower portions 13*a* against one of the cam tracks 12, each of the pistons 13 being accommodated in a separate passage 15 within the rotor 1 for reciprocation and being acted on by a compression spring 14 which presses the actuating portion 13*a* of the respective piston 13 against the respective cam track 12 so that the cam follower portion 13*a* of the respective piston 13 follows the configuration of the respective cam track 12 and thus reciprocates the respective piston 13 within the passage 15 in which the respective piston 13 is accommodated.

The two sets of pistons 13 and the associated passages 15 are arranged along a separate radial plane each, which is axially spaced from the radial plane along which the pistons 13 and the passages 15 of the other set are arranged. A separate control sleeve 16 or 17 is associated with each of the above-mentioned sets of pistons 13 and passages 15, the control sleeves 16 and 17 being angularly displaceably mounted on a distributor 18. The control sleeves 16 and 17 register with one another in the axial direction and are coaxially surrounded by the rotor 1 which is supported thereon. The two control sleeves 16 and 17 are provided at their respective peripheries with respective valve openings 19, through which the passages 15 can be communicated, via the distributor 18 with one of the pressure nipples 10 or 11.

The two control sleeves 16 and 17 can be angularly displaced, from the exterior of the housing 8*a*, 8*b* by a common drive, through the same angle but in the opposite directions. The angularly displacing arrangement for the control sleeve 16 includes a displacement shaft 20 which is coaxially accommodated in the interior of the rotor 1. The displacement shaft 20 is connected, via a disk 21 rigidly connected thereto, with the control sleeve 16 for joint rotation therewith. At the end of the displacement shaft 20 which is located leftwardly in the illustration of FIG. 1, there is mounted a bevel gear 22 for joint rotation with the displacement shaft 20.

The angularly displacing arrangement for the control sleeve 17 includes another bevel gear 23 which is threadingly connected with the control sleeve 17 by bolts 24. As particularly seen in FIG. 3, the bolts 24 pass through part-circular elongated slots 25 provided in the housing lid 9. The two bevel gears 22, 23 are commonly rotated by a drive 26 which includes a bevel pinion which meshes with the bevel gears 22 and 23. As may be further ascertained from FIG. 1 of the drawing, a leakage duct 27 is defined in the housing 8*a*, 8*b* a connector 28 which is particularly seen in FIG. 2, communicating with this leakage duct 27.

In the illustrated embodiment of the present invention, each of the cam tracks 12 has two raised portions, while ten of the pistons 13 are provided in ten of the passages 15 in each of the sets of pistons 13 and passages 15. The respective cam tracks 12, and also the rotor 1, are symmetrical with respect to the axis of rotation of the rotor 1 so that the forces which act on the pistons 13 subject the rotor 1 to a pure torque; thus, no forces are transmitted to the bearing 5 which would have a tendency to tilt the rotor 1 in the gearing 5.

When the actuating portion 13*a* of the respective piston 13 contacts the highest region of the raised portion of the respective cam track 12, the respective piston 13 is closest to the axis of rotation of the rotor 1. Then, as the cam follower portion 13*a* of the respective piston 13 follows the descending slope of the respective cam track 12, due to the action of the spring 14 on the respective piston 13, the respective piston 13 draws the working fluid into the respective working chamber of the respective passage 15. On the other hand, as the cam follower portion 13*a* of the respective piston 13 moves along the ascending region of the respective raised portion of the respective cam track 12, the respective piston 13 expels the working fluid from the working chamber of the respective passage 15.

Figure 4:
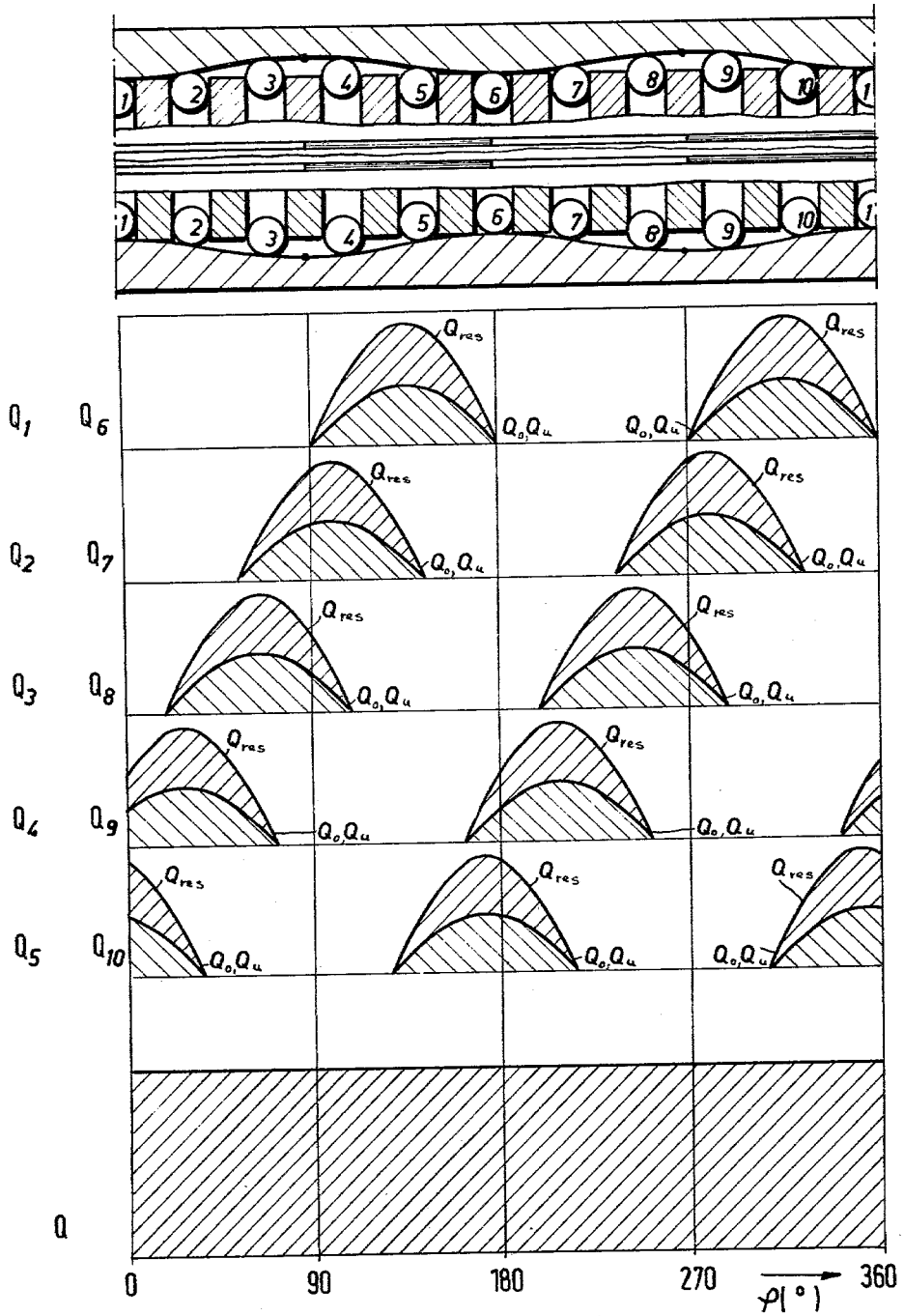
FIG. 4 is a diagrammatic representation which illustrates a development of the cam track and of the rotor for each of the two sets of passages, as adjusted for a maximum output, and also illustrating individual graphs indicating the displacement volumes of the individual pistons.
Figure 5:
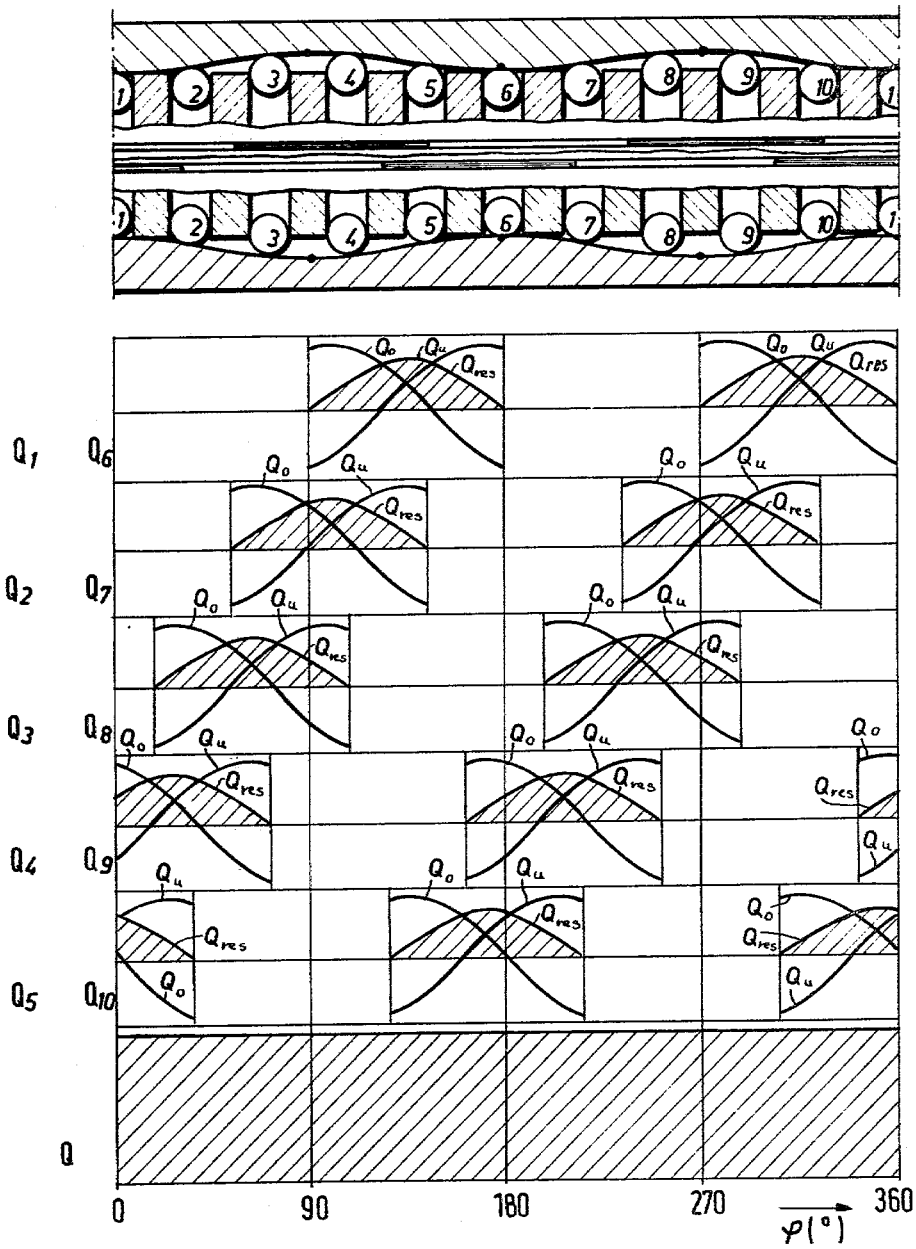
FIG. 5 is a view similar to FIG. 4 but with the control sleeves adjusted to a lower throughput.
Figure 6:
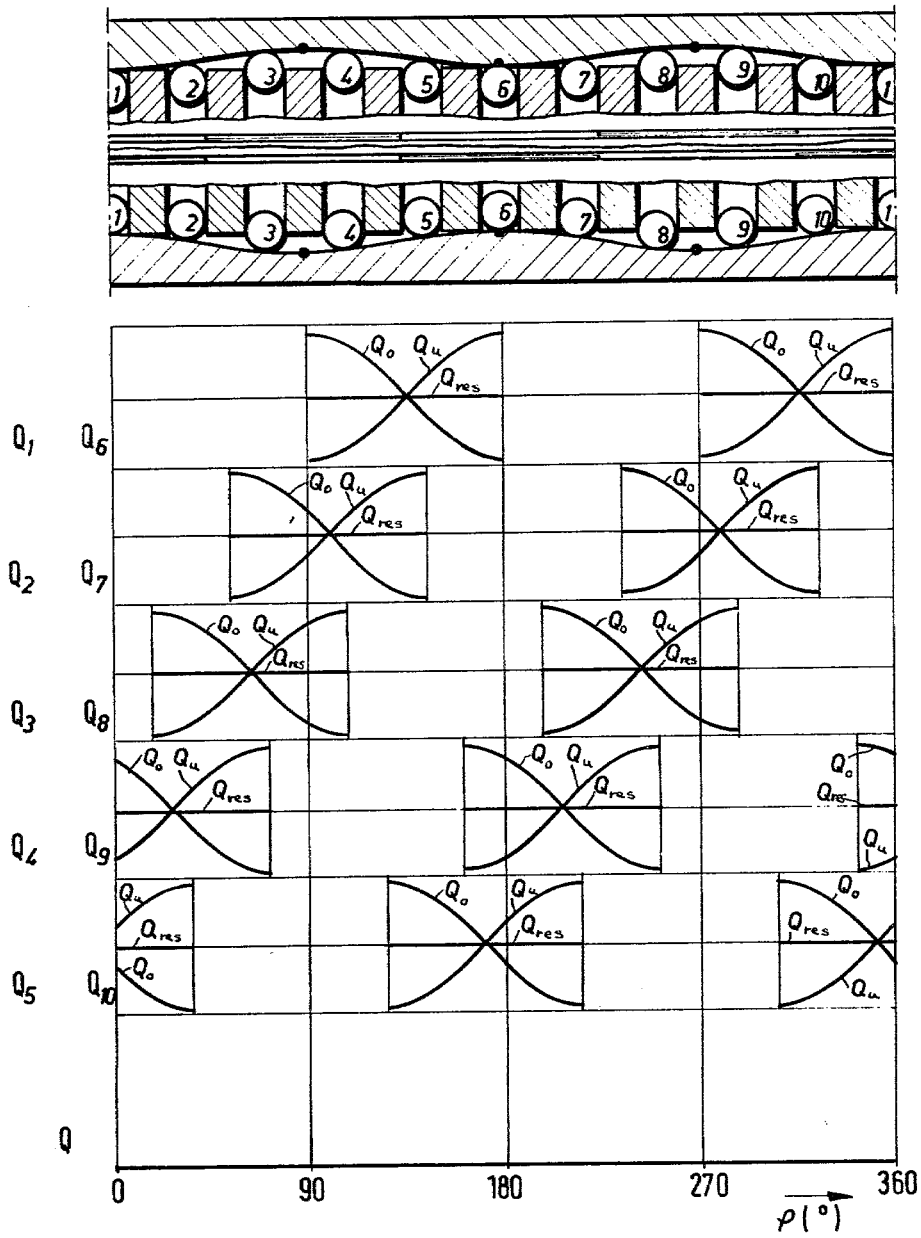
FIG. 6 is a view similar to FIGS. 4 and 5 but with the control sleeves adjusted to zero throughput.

Turning now to FIGS. 4, 5 and 6, it may be seen that these Figures illustrate, at the respective tops thereof, the sinusoidal development of the two cam tracks 12 with respect to the rotor 1. The heavier lines illustrate, in a symbolic manner, the length of the working phases which are determined by the positions of the valve openings 19 of the control sleeves 16 and 17.

More particularly, FIG. 4 illustrates an initial position in which the valve openings 19 of the control sleeves 16 and 17 are so positioned as to cooperate with the cam tracks 12 from the corresponding points thereof. In this initial position, there is obtained a maximum throughput of the machine. In the individual diagrams which are located underneath the above-mentioned development of the cam tracks 12 and of the rotor 1 for each of the sets, there are illustrated the respective displacement volumes $Q_1$ to $Q_{10}$ of the individual pistons 13 which become operative at different angular positions of the rotor 1 in their pumping phases, as a function of the angle of displacement $\phi$ of the rotor 1. In these diagrams, $Q_u$ always indicates the displacement volumes, as a function of time, of the respective pistons 13 of the left set in FIG. 1, and $Q_o$ those of the pistons 13 of the right set. The displacement volume $Q_{res}$ results from the addition of the displacement volumes $Q_u$ and $Q_o$ of the two pistons 13 which are respectively arranged opposite one another in the rotor 1; this addition is accomplished by the control sleeves 16 and 17. The summation of these individual displacement volumes obtained by the actions of the cooperating piston 13 results in the total displacement volume $Q_{ges}$, which is constant and virtually pulsation-free as required.

FIG. 5 illustrates the corresponding values, but which have been modified by angularly displacing the control sleeves 16 and 17. As a result of the angular displacements of the control sleeves 16 and 17, the latter commence their operations from different points of the cam tracks 12. Thus, for instance, when the control sleeve 17 is so arranged that the opening 19 thereof opens the communication of the respective passages 15 of the left set of passages 15 a certain angle before the respective pistons 13 reach the reversing point thereof in the pumping phase, then the control sleeve 16 is so positioned relative to its associated cam track that, at the same time, the passage 15 of the right set of passages 15 commences its communication with the opening 19 of the control sleeve 16 at the same angle past the reaching of the reversing point of the respective piston 13 of the right set of pistons. Furthermore, the length of the working phase corresponds to the length of one stroke of the respective piston 13. Based on the above-mentioned angular displacement of the control sleeves 16 and 17, the individual displacement volumes of the two sets of passages 15 and the pistons 13 accommodated thereon are no longer identical. This is apparent from the diagrams which illustrate the respective values of $Q_{res}$ for the cooperating oppositely located pistons 13. However, here again, the summation of all of the resulting individual displacement volumes again results in a constant displacement volume which, however, is more than that obtained in the position of the control sleeves 16 and 17 illustrated in FIG. 4.

FIG. 6 shows the conditions prevailing when the respective control sleeves 16 and 17 are further angularly displaced. The angle of the angular displacement is here so selected that the displacement volume of each of the pistons 13 is exactly the same as the displacement volume of the associated piston 13 reached in the other set of passages 15 from those of the first-mentioned piston 13, while the first-mentioned piston 13 works in a pumping stroke and the second-mentioned piston 13 works in a suction stroke, or vice versa. Thus, the resulting displacement volume $Q_{res}$, and thus even the total volume $Q_{ges}$, are equal to zero. Now, should the angular displacement of the control sleeves 16 and 17 continue beyond this point, the direction of flow of the working medium is reversed. In other words, if the nipple 10 originally was a high-pressure nipple and the nipple 11 a low-pressure nipple, the nipple 10 will now become a low-pressure nipple and the nipple 11 will become a high-pressure nipple. As a result of this, supposing that the machine of the present invention is being used as a pump, the pistons 13 in their totality no longer supply the pressurized working medium into the nipple 10 but rather draw in the working fluid through the nipple 10. On the other hand, again assuming the utilization of the machine of the present invention as a pump, the pistons 13 will deliver the pressurized working fluid into the nipple 11.

Figure 7:
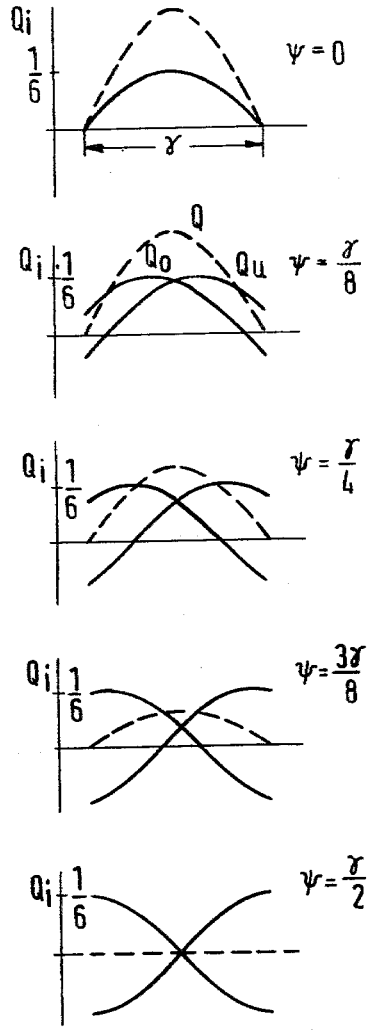
FIG. 7 is a diagrammatic view illustrating the individual and the associated resultant added displacement volumes of two associated pistons of the two sets, in the positions of the control sleeves corresponding to those of FIGS. 4, 5 and 6, respectively.
Figure 8:
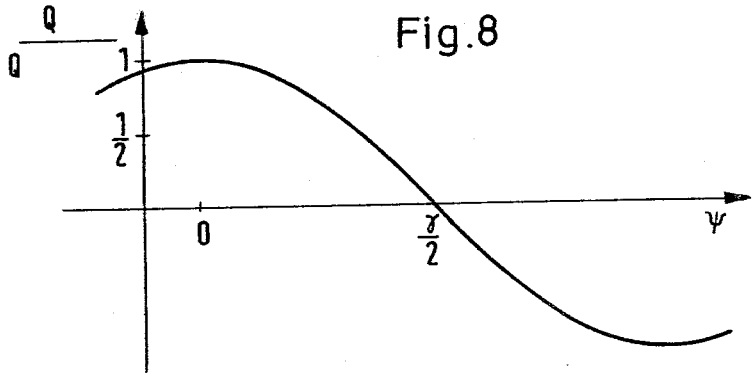
FIG. 8 is a diagram illustrating the adjustment characteristic of the machine.

The angle of the angular displacement of the control sleeves 16 and 17 is a function of the working cycle which, in turn, depends on the number of the raised portions of the respective tracks 12. Thus, when the respective cam track 12 includes two raised portions, two pumping and two suction phases are obtained during a single rotation of the rotor 1. FIG. 7 illustrates, once more, the individual displacement volumes $Q_o$ and $Q_u$ and the corresponding displacement volumes $Q_{res}$ of the associated pair of pistons 13. However, unlike in FIGS. 4–6 where the above-mentioned displacement volumes have been illustrated for all of the pistons 13 distributed about the periphery of the rotor 1, FIG. 7 illustrates only the conditions prevailing in a single pair of pistons 13 during a single working phase, but for the same angularly displaced positions as those indicated in FIGS. 4–6. It will be appreciated that it is not necessary to illustrate the performance of the other pistons 13 inasmuch as they are identical to those illustrated, and the distribution thereof over the periphery of the rotor 1 does not change. The region from the maximum to the zero displacement volume is being illustrated in examples. The positive as well as the negative region, that is, the reversal of the flow of the working medium, are symmetrical so that an illustration of the positive region is quite sufficient. An adjustment characteristic of the total performance of the fluid-displacement machine of the present invention can be constructed from the characteristic behavior lines of FIG. 7. The related volumetric stream is illustrated in FIG. 8 as a function of the adjustment angle $\psi$ of the control sleeves 16 and 17. The reference character $\gamma$ indicates the length of the working stroke of the individual piston 13. It will be seen from FIG. 8 that the radial piston machine of the present invention has a sinusoidal total adjustment characteristic.

It will be understood that each of the elements described above, or two or more together, may also find a useful application in other types of constructions differing from the types described above.

While the invention has been illustrated and described an embodied in a throughput-adjustable radial piston machine, it is not intended to be limited to the details shown, since various modifications and structural changes may be made without departing in any way from the spirit of the present invention.

Without further analysis, the foregoing will so fully reveal the gist of the present invention that occurs can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fluid-displacement machine comprising a stator component; a rotor component mounted on said stator component for rotation about an axis relative thereto; two axially spaced circumferentially extending cam tracks both having a sinusoidal shape and being stationary relative to said stator component; means for bounding two sets of radially extending passages in said rotor component, said passages having respective open ends which always face a different one of said cam tracks for each of said sets; a plurality of pistons each accommodated for reciprocation, and bounding a chamber, in one of said passages of said two sets and each having a cam follower portion; means for so biasing each respective piston toward the respective cam track that said cam follower portion thereof follows, and reciprocates the respective piston in dependence on, the configuration of the respective cam track; high-pressure and low-pressure conduits; means for communicating said conduits with said chambers, including two control members each of which is interposed between said conduits and said chambers of one of said sets and each of which is mounted for angular displacement about said axis relative to said stator component; means for simultaneously angularly displacing said two control members in opposite directions relative to said stator component and for arresting said control members in the respectively assumed positions thereof; each of said cam tracks having a plurality of raised portions uniformly distributed about its circumference; and the ratio of the number m of said passages in each of said sets to the common devisor T of m and of the number of said raised portions per cam track being m/I-5.

2. A machine as defined in claim 1, wherein said angularly displacing means is operative for displacing said two control members through the same angle.

3. A machine as defined in claim 1, wherein said two control members are sleeves which axially abut each other.

4. A machine as defined in claim 3, wherein said rotor component surrounds and is supported on said sleeves.

5. A machine as defined in claim 4, wherein said stator component includes a housing and a housing lid; and wherein said rotor component is further supported in said housing lid in a cantilevered fashion.

6. A fluid-displacement machine comprising a statory component; a rotor component mounted on said stator component for rotation about an axis relative thereto; two axially spaced circumferentially extending cam tracks both stationary relative to said stator component; means for bounding two sets of radially extending passages in said rotor component, said passages having respective open ends which always face a different one of said cam tracks for each of said sets; a plurality of pistons each accommodated for reciprocation, and bounding a chamber, in one of said passages of said two sets and each having a cam follower portion; means for so biasing each respective piston toward the respective cam track that said cam follower portion thereof follows, and reciprocates the respective piston in dependence on, the configuration of the respective cam track; high-pressure and low-pressure conduits; means for communicating said conduits with said chambers, including two control sleeves axially abutting each other, each of said sleeves being interposed between said conduits and said chambers of one of said sets and each of which is mounted for angular displacement about said axis relative to said stator component; means for simultaneously angularly displacing said two control sleeves in opposite directions relative to said stator component and for arresting said control members in the respectively assumed positions thereof; and wherein said angularly displacing means for one of said sleeves includes a displacing shaft coaxially accommodated in said rotor component, a connecting disk mounted on said displacing shaft for joint rotation therewith; and means for rigidly connecting said one sleeve to said connecting disk.

7. A machine as defined in claim 6, wherein said angularly displacing means for the other of said sleeves includes a gear which is connected to said other sleeve for joint rotation therewith.

8. A machine as defined in claim 7, wherein said gear is a bevel gear; wherein said angularly displacing means for said one sleeve further includes another bevel gear mounted on said displacing shaft for joint rotation therewith; and wherein said angularly displacing means further includes means for driving said bevel gear and said other bevel gear in opposite directions about said axis.

9. A machine as defined in claim 8, wherein said driving means includes a common bevel gear which meshes with said bevel gear and with said other bevel gear to drive the same at the same angular speeds.

* * * * *